US010183828B2

(12) United States Patent
Iwasaki

(10) Patent No.: US 10,183,828 B2
(45) Date of Patent: Jan. 22, 2019

(54) SHEET DISCHARGE DEVICE AND IMAGE FORMING APPARATUS

(71) Applicant: CANON KABUSHIKI KAISHA, Tokyo (JP)

(72) Inventor: Hisanori Iwasaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/788,086

(22) Filed: Oct. 19, 2017

(65) Prior Publication Data

US 2018/0111780 A1 Apr. 26, 2018

(30) Foreign Application Priority Data

Oct. 26, 2016 (JP) ..... 2016-209135

(51) Int. Cl.

| | |
|---|---|
| ***B65H 29/12*** | (2006.01) |
| ***B65H 29/70*** | (2006.01) |
| ***G03G 15/00*** | (2006.01) |
| ***B65H 29/14*** | (2006.01) |

(52) U.S. Cl.

CPC ..... *B65H 29/125* (2013.01); *B65H 29/14* (2013.01); *B65H 29/70* (2013.01); *G03G 15/6552* (2013.01); *B65H 2301/5122* (2013.01); *B65H 2301/51214* (2013.01); *B65H 2404/143* (2013.01); *B65H 2404/611* (2013.01); *B65H 2801/06* (2013.01)

(58) Field of Classification Search

CPC ..... B65H 29/125; B65H 29/14; B65H 29/52; B65H 29/70

USPC ..... 271/188, 209

See application file for complete search history.

(56) References Cited

U.S. PATENT DOCUMENTS

| | | | | |
|---|---|---|---|---|
| 6,794,633 | B2 | 9/2004 | Iwasaki | |
| 9,169,093 | B2 * | 10/2015 | Aoyama | B65H 5/26 |
| 9,212,017 | B2 * | 12/2015 | Furusawa | B65H 29/125 |
| 9,316,985 | B2 * | 4/2016 | Miwa | G03G 15/6552 |
| 9,382,089 | B2 * | 7/2016 | Tanaka | B65H 5/062 |
| 9,395,671 | B1 * | 7/2016 | Yano | G03G 15/6529 |
| 9,540,204 | B2 * | 1/2017 | Michibata | B65H 29/70 |
| 9,676,580 | B2 * | 6/2017 | Baek | B65H 27/00 |
| 2017/0269532 | A1 | 9/2017 | Yamabe et al. | |

FOREIGN PATENT DOCUMENTS

| | | |
|---|---|---|
| JP | 02-305771 A | 12/1990 |

* cited by examiner

*Primary Examiner* — David H Bollinger
(74) *Attorney, Agent, or Firm* — Venable LLP

(57) ABSTRACT

A sheet discharge device includes: a conveying portion which conveys the sheet in a conveying direction with the sheet interposed between a first roller and a second roller; a first conveying guide; a second conveying guide; a rotating portion which is disposed on a shaft of the first roller and has an outer diameter larger than that of the first roller; and a guide portion which is provided in the first conveying guide and in which an interval between the guide portion and the opposite second conveying guide becomes narrower toward a downstream side in the conveying direction, the guide portion being located at a position corresponding to the rotating portion in a sheet width direction orthogonal to the conveying direction.

12 Claims, 4 Drawing Sheets

SHEET DISCHARGE DEVICE AND IMAGE FORMING APPARATUS

BACKGROUND OF THE INVENTION

Field of the Invention

The present invention relates to a sheet discharge device which discharges a sheet, and an image forming apparatus having the sheet discharge device.

Description of the Related Art

A conventional sheet discharge device discharges a sheet such as a transferred sheet on which an image is formed from a main body of the image forming apparatus. The sheet discharge device includes a driving roller which receives a sheet on which an image is fixed by a fixing device to convey or discharge the sheet, and a driven roller which is driven and rotated by being pressed against the driving roller.

When discharging the sheet from the main body of the image forming apparatus onto a discharge tray, the sheet discharge device rounds or skews on the sheet discharge tray due to thermal deformation after fixing, which causes problems in terms of stacking properties. For this reason, the sheet is slightly curved in a width direction orthogonal to a conveying direction (discharge direction) by stiffening rollers to perform stiffening and ensure the stacking properties.

Specifically, as a conventional sheet discharge device, a configuration has been proposed in which a stiffening roller having a diameter larger than that of the driving roller is provided on the roller shaft of the driving roller, and the sheet is slightly curved in the width direction orthogonal to the conveying direction by the stiffening roller and is discharged in the state of being stiffened (Japanese Patent Laid-Open No. H2-305771).

However, in the conventional sheet discharge device, when a thick sheet is conveyed, an entry angle of the sheet to the stiffening rollers having a larger diameter than that of the driving roller becomes worse than the entry angle of the sheet to the driving roller, there is a problem which causes folding or jamming of edge of the sheet (end of the sheet).

Therefore, it is desirable to prevent folding or jamming of the edge of the sheet (end of the sheet) due to the leading end of the sheet abutting on the surface of the stiffening roller.

SUMMARY OF THE INVENTION

In order to solve the above issue, a sheet discharge device comprises: a conveying portion which includes a first roller contacting a first surface of a sheet and a second roller contacting a second surface of the sheet and which conveys the sheet in a conveying direction with the sheet interposed between the first roller and the second roller; a first conveying guide which is provided on an upstream of the conveying portion in the conveying direction to guide the first surface of the sheet; a second conveying guide which is provided to face the first conveying guide to guide the second surface of the sheet; a rotating portion which is disposed on a shaft of the first roller and has an outer diameter larger than that of the first roller; and a guide portion which is provided in the first conveying guide and in which an interval between the guide portion and the second conveying guide becomes narrower toward a downstream side in the conveying direction, the guide portion being located at a position corresponding to the rotating portion in a sheet width direction orthogonal to the conveying direction.

Further features of the present invention will become apparent from the following description of exemplary embodiments with reference to the attached drawings.

DESCRIPTION OF THE EMBODIMENTS

Exemplary embodiments of the invention will be described in detail below with reference to the accompanying drawings. However, the dimensions, materials, shapes, relative positions thereof, and the like of the components described in the following embodiments should be appropriately changed according to the configuration or various conditions of the apparatus to which the invention is applied. Therefore, unless otherwise specified, it is not intended to limit the scope of the invention only thereto.

[First Embodiment]

Figure 1:
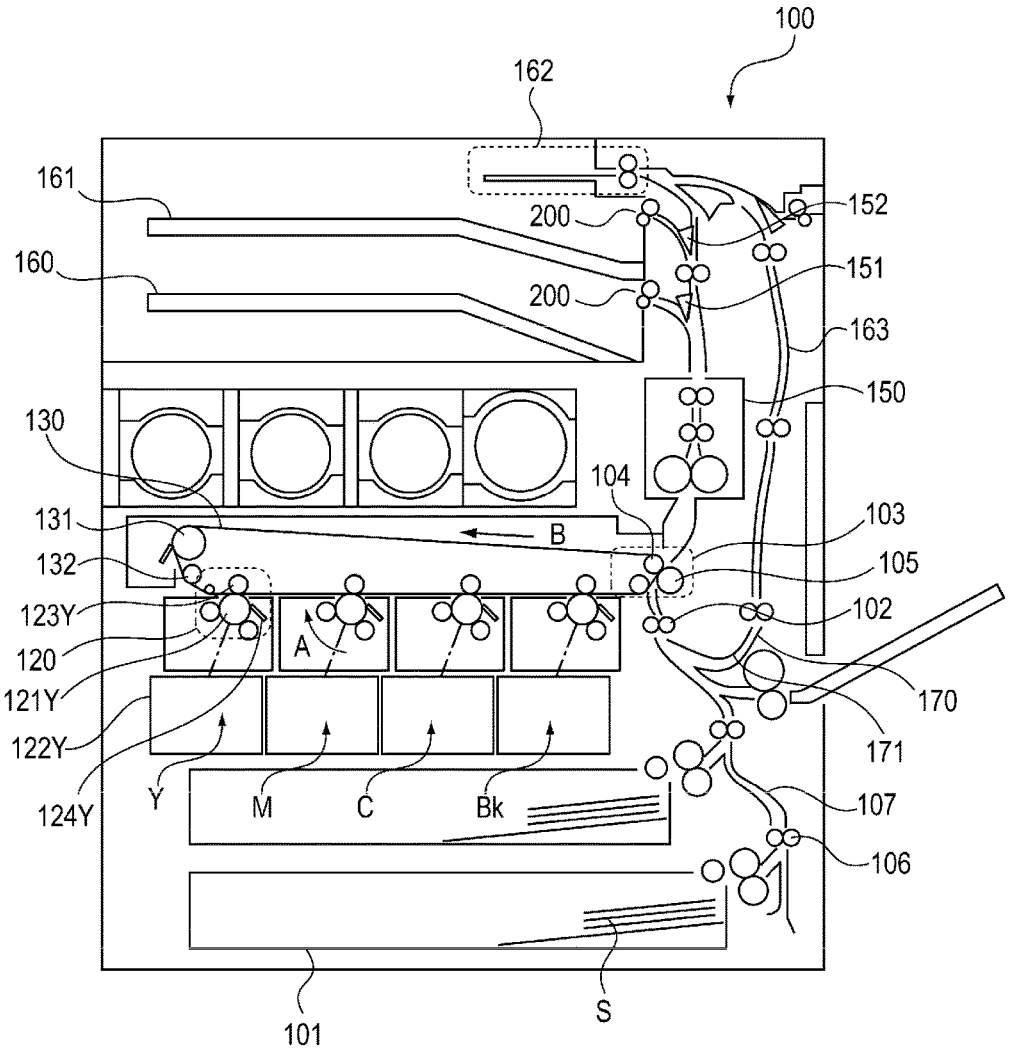
FIG. 1 is an explanatory view of an image forming apparatus including a sheet discharge device according to an embodiment.

With reference to FIG. 1, a configuration of an image forming apparatus 100 provided with a sheet discharge device according to this embodiment will be described. FIG. 1 is a schematic sectional view of the image forming apparatus 100 provided with the sheet discharge device according to this embodiment.

In the image forming apparatus 100 illustrated in FIG. 1, the sheet S is stored in the form of being stacked in a sheet feed storage 101 which is a sheet stacking portion, and is sent out by a sheet feeding mechanism as a feeding portion. The sheet S sent out by the sheet feeding mechanism passes through a conveying path, is subjected to a skew feeding correction in the registration unit 102, and then, is sent to a secondary transfer portion 103. The secondary transfer portion 103 is a toner image transfer nip portion to the sheet S formed by a secondary transfer inner roller 104 and a secondary transfer outer roller 105, and adsorbs an unfixed image onto the sheet surface by applying a predetermined pressing force and electrostatic additional bias. The conveying path through which the sheet S is conveyed includes a sheet conveying portion 106 (for example, a pair of rollers, a suction belt and the like) disposed at an appropriate interval to deliver the sheet S while holding the sheet S, and a sheet guide 107 which guides the sheet S, while suppressing the behavior thereof.

The process of forming an image sent to the secondary transfer portion 103 at the same timing as the conveying process of the sheet S up to the secondary transfer portion 103 will be described. The image forming portion 120 mainly includes a photoreceptor 121, an exposure mechanism 122, a development device (not illustrated), a primary transfer mechanism 123, and a photoreceptor cleaner 124. The surface of the photoreceptor 121 rotating in a direction of arrow A in the drawing is uniformly charged by a charging portion beforehand. The exposure mechanism 122 emits light to the charged photoreceptor 121, based on the sent signal of the image information, and an electrostatic latent image is formed on the photoreceptor 121 via a diffracting portion or the like (not illustrated) as appropriate.

The electrostatic latent image formed on the photoreceptor 121 is subjected to a toner development by a development device, and a toner image is formed on the photoreceptor 121. Thereafter, predetermined pressing force and electrostatic additional bias are applied by the primary transfer mechanism 123, and the toner image is transferred onto an intermediate transfer belt. Thereafter, the residual toner remaining on the photoreceptor is collected by the photoreceptor cleaner 124, and the photoreceptor 121 prepares for the next image formation again. In the case of the image forming apparatus illustrated in FIG. 1, there are four sets of yellow (Y), magenta (M), cyan (C), and black (Bk) image forming portions 120. Of course, the image forming portions 120 are not limited to four colors, and the order of colors is not limited thereto.

Next, the intermediate transfer belt 130 will be described. The intermediate transfer belt 130 is stretched by rollers such as a driving roller 131, a tension roller 132, and a secondary transfer inner roller 104, and is rotationally driven in a direction of an arrow B in the drawing. Therefore, the image forming processes of the respective colors that are processed in parallel by the above-described yellow (Y), magenta (M), cyan (C), and black (Bk) image forming portions 120 are performed at the timing of superimposing the upstream toner images primarily transferred onto the intermediate transfer belt. As a result, a full-color toner image is finally formed on the intermediate transfer belt and is conveyed to the secondary transfer portion 103.

The full-color toner image is transferred onto the sheet at the secondary transfer portion 103 by the conveying process and the image forming process of the sheet S described above. Thereafter, the sheet S is conveyed to the fixing portion 150, and the toner image is melted and fixed by a pressing portion or a heating portion. The route of the sheet S having the fixed image obtained in this manner is selected whether the sheet is discharged from the sheet discharge tray 160 or the sheet discharge tray 161 by a branch conveying mechanism 151, and the sheet is discharged by a discharging portion (sheet discharge device) which will be described later. Alternatively, in the case where a duplex image formation is required, the route of the sheet S is selected by the branch conveying mechanism 152, the sheet is conveyed from a reverse conveying mechanism 162 to the duplex conveying mechanism 163, and is conveyed to the image forming portion again.

Next, a sheet discharge device as a discharging portion in the image forming apparatus will be described. First, the sheet discharge device of the comparative example will be described, and then, the sheet discharge device according to this example will be described.

Figure 4A:
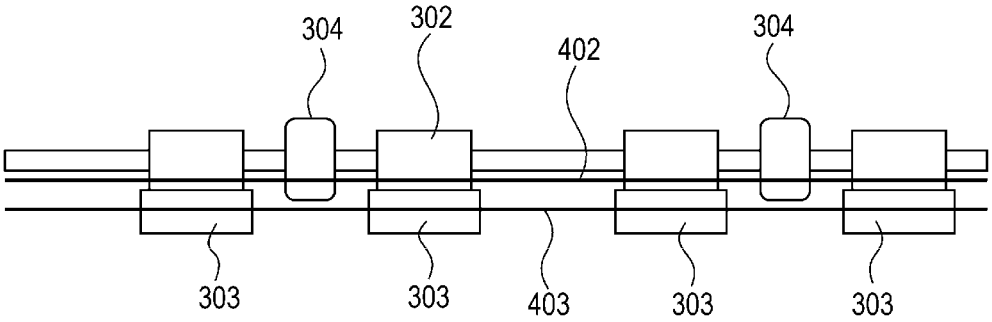
FIGS. 4A and 4B are explanatory views of a sheet discharge device of a comparative example.

Here, the sheet discharge device of the comparative example will be described with reference to FIGS. 4A and 4B. FIG. 4A is a schematic front view of the sheet discharge device of the comparative example, and FIG. 4B is a schematic cross-sectional view of the sheet discharge device of the comparative example.

Figure 4B:
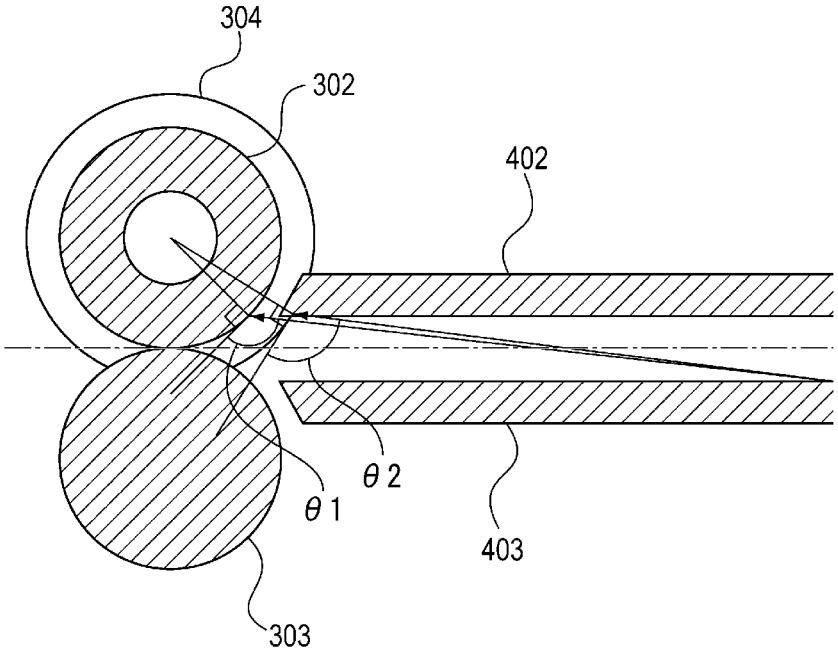

As illustrated in FIGS. 4A and 4B, the sheet discharge device of the comparative example includes a driving roller 302 for discharging a sheet, such as transferred sheet, on which an image is formed, and a driven roller 303 driven to rotate by being pressed against the driving roller 302. The sheet is discharged and conveyed, while being nipped between the driving roller 302 and the driven roller 303. Further, in order to guide the sheet to a nipping portion (pressing portion) between the driving roller 302 and the driven roller 303, a conveying guide 402 disposed on the side of the driving roller on the upstream side of the driving roller 302 in the conveying direction, and a conveying guide 403 disposed on the side of the driven roller on the upstream side of the driven roller 303 in the conveying direction.

When discharging the sheet onto the sheet discharge tray, the discharged sheet is rounded or skewed on the sheet discharge tray due to a thermal deformation after fixing, which causes a problem in terms of stacking properties. Therefore, a stiffening roller 304 having an outer diameter (the diameter is about 0.5 to 2 mm) larger than the diameter (about 10 to 20 mm in this case) of the driving roller 302 is provided on the roller shaft of the driving roller 302, and the sheet is discharge by being stiffened. The stiffening roller 304 includes two or more upper and lower members, and is mounted to the roller shaft of the driving roller by engaging the respective members with each other. In such a configuration, since the stiffening roller 304 is larger in diameter than the driving roller 302, the sheet guided by the conveying guides 402 and 403 hits the surface of the stiffening roller 304 earlier than the driving roller 302. Further, an entry angle θ2 of the leading end of the sheet to the stiffening roller 304 is larger than an entry angle θ1 of the leading end of the sheet to the driving roller 302. Therefore, in some cases, there is a problem that dents occur in the edge of the leading end of the sheet occurs.

Figure 2A:
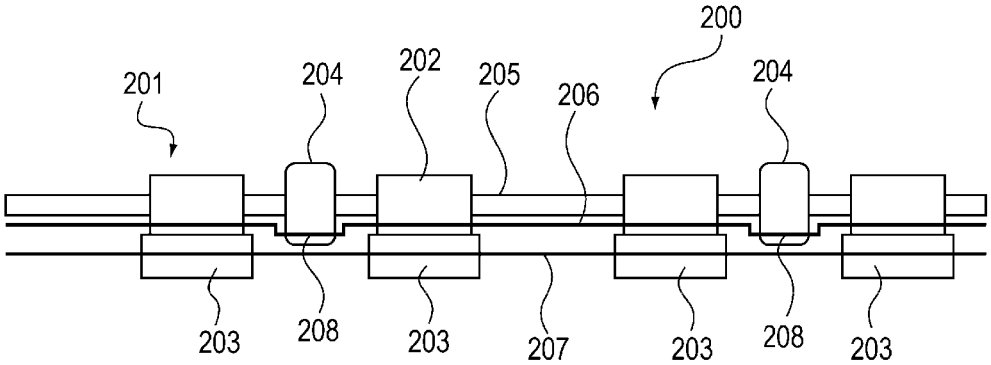
FIGS. 2A and 2B are explanatory views of the sheet discharge device according to an embodiment.
Figure 2B:
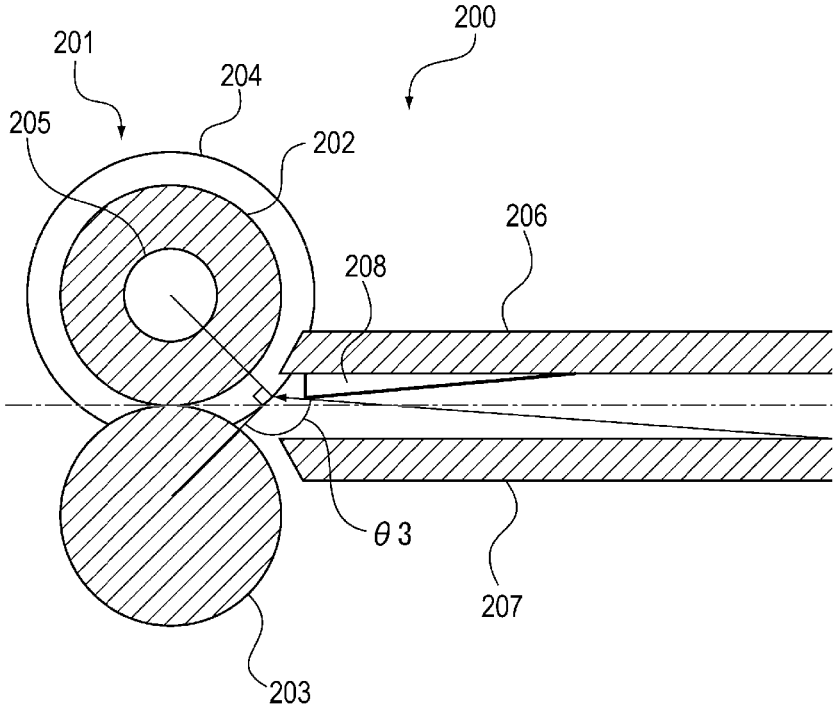

As compared to the sheet discharge device of the comparative example, the sheet discharge device according to the present embodiment is configured as follows. With reference to FIGS. 2A and 2B, a sheet discharge device according to this embodiment will be described. FIG. 2A is a schematic front view of the sheet discharge device according to the present example, and FIG. 2B is a schematic cross-sectional view of the sheet discharge device according to this example.

As illustrated in FIGS. 2A and 2B, a sheet discharge device 200 according to the present embodiment includes, as a conveying portion 201 which nips and conveys the sheet, a driving roller 202 for discharging a sheet such as a transferred sheet on which an image is formed, and a driven roller 203 driven to rotate by being pressed against the driving roller 202.

Further, the sheet discharge device 200 includes a first conveying guide 206 which is provided on the upstream side of the sheet in the conveying direction from the conveying portion 201 to guide the driving roller side of the sheet, and a second conveying guide 207 which is provided to face the first conveying guide 206 to guide the driven roller side of the sheet. The first conveying guide 206 and the second conveying guide 207 guide the sheet to a nipping portion (pressure contact portion) between the driving roller 202 and the driven roller 203. An interval between the conveying guides including the first conveying guide 206 and the second conveying guide 207 is set to about 1 to 5 mm here.

Further, the sheet discharge device 200 has a stiffening roller 204 as a stiffening member which is disposed on the roller shaft 205 of the driving roller 202 and has an outer diameter larger than the diameter of the driving roller 202. The stiffening roller 204 is a rotating portion that is rotatably disposed on the roller shaft 205 of the driving roller 202, and is a stiffening member which slightly bends the sheet in the width direction orthogonal to the conveying direction to stiffen the sheet.

Furthermore, in the sheet discharge device 200 according to the present embodiment, a guide portion, in which the interval between the first conveying guide 206 and the opposite second conveying guide 207 gradually narrows, is provided at a position corresponding to the stiffening roller 204 of the first conveying guide 206. In the present embodiment, the guide portion is a guide surface 208 formed in a convex shape toward the opposite second conveying guide 207 at a position corresponding to the stiffening roller 204 of the first conveying guide 206. Here, the guide surface 208 is formed at a position corresponding to the stiffening roller 204 of the first conveying guide 206 such that the interval between the first conveying guide 206 and the second conveying guide 207 is narrowed by about 0.5 to 2 mm in the conveying direction of the sheet.

As described above, by providing a guide surface in which the interval between the conveying guides gradually narrows at the position corresponding to the stiffening roller 204 of the first conveying guide 206, it is possible to prevent folding or jamming of the sheet due to the leading end of sheet abutting on the surface of the stiffening roller.

Further, an entry angle θ3 of the leading end of the sheet guided by the guide surface 208 to the stiffening roller 204 is formed to be substantially the same as the entry angle θ1 of the leading end of the sheet to the driving roller 202. In this manner, by making the entry of the leading end of the sheet into the stiffening roller 204 to be equal to that of the driving roller 202, the entry of the sheet into the stiffening roller becomes gentle, thereby making it possible to prevent the occurrence of folding or jamming of the sheet.

[Other Embodiments]

Figure 3A:
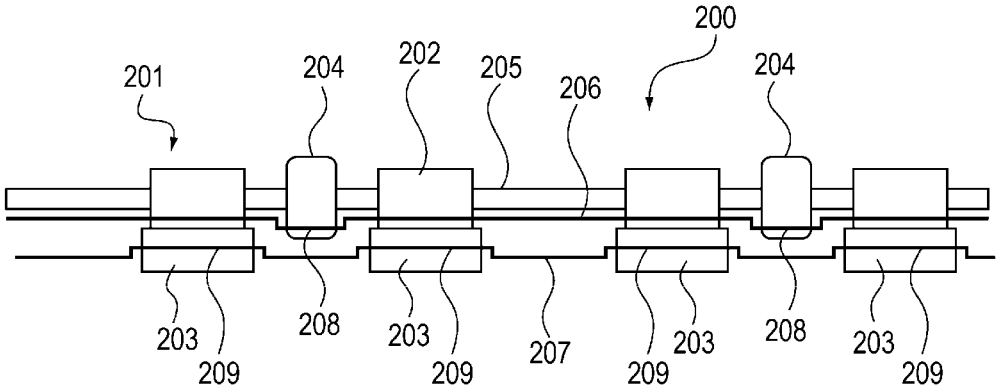
FIGS. 3A and 3B are explanatory views of the sheet discharge device according to an embodiment.
Figure 3B:
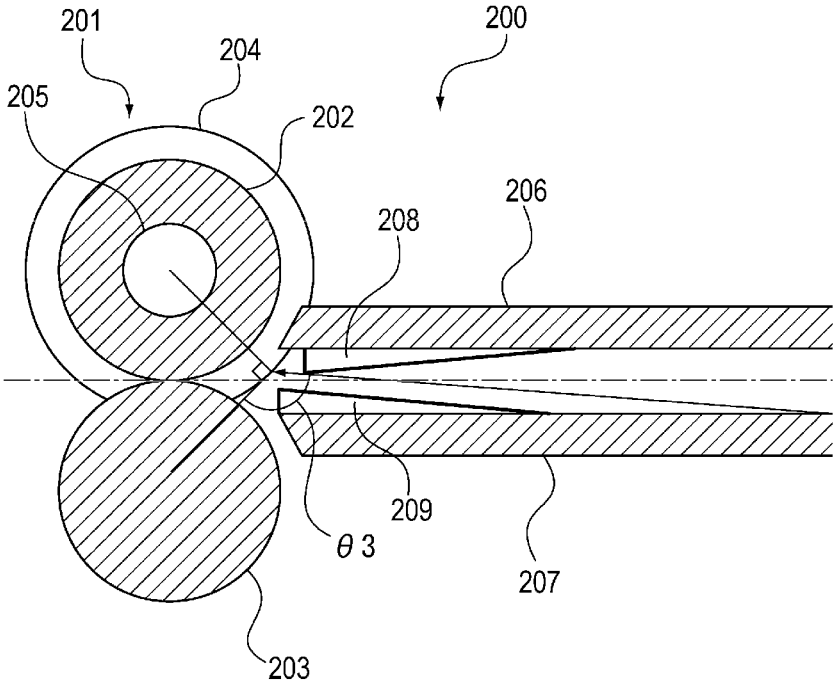

In the above embodiment, the interval between the guide surface 208 and the second conveying guide 207 is narrower than the interval between the first conveying guide 206 and the second conveying guide 207, and the conveying guide resistance at the time of conveying the stiffened sheet increases. Therefore, as illustrated in FIGS. 3A and 3B, the second conveying guide 207 facing the guide surface 208 is disposed in a direction in which the conveying guide interval is widened by about 0.5 to 2 mm, and a driven roller guide surface 209 as a second guide portion is formed in the second conveying guide 207 which guides the sheet to the driven roller 203 such that the conveying guide interval is gradually narrowed by about 0.5 to 2 mm in the conveying direction. As a result, it is possible to prevent the occurrence of folding or jamming of the sheet, and at the same time, it is possible to reduce the conveying guide resistance when conveying the stiffened sheet.

Further, in the above-described embodiment, as the guide portion provided in the first conveying guide, at the position of the first conveying guide 206 corresponding to the stiffening roller 204, the guide surface 208 formed in a convex shape toward the opposite second conveying guide 207 is exemplified, but the invention is not limited thereto. For example, it is also possible to narrow the interval of the aforementioned conveying guide, using a rotating member such as a rotatable roller instead of the aforementioned guide surface. According to this configuration, in addition to the effects of the above-described embodiment, it is possible to reduce the conveyance resistance of the sheet. Further, it is also possible to narrow the interval of the aforementioned conveying guide, using the rib instead of the guide surface. Even with such a configuration, it is possible to obtain the same effect as the aforementioned embodiment, and it is possible to further reduce the conveyance resistance of the sheet.

Further, in the above-described embodiment, a printer has been exemplified as the image forming apparatus, but the invention is not limited thereto. Other image forming apparatuses such as copying machines and facsimile machines, or other image forming apparatuses such as multifunction machines combining these functions may be used. The same effect can be obtained by applying the invention to the sheet discharge device used in the image forming apparatus.

Further, in the above-described embodiment, the sheet discharge device integrally provided in the image forming apparatus has been exemplified, but the invention is not limited thereto. For example, a sheet discharge device attachable to and detachable from the image forming apparatus may be adopted, and by applying the invention to the sheet discharge device, the same effect can be obtained. Further, as the sheet discharge device, a sheet processing device such as a finisher including a processing portion for performing processing such as binding or folding on the sheet, or a sheet discharge device for discharging the sheet in the sheet processing apparatus such as a sorter for sorting the sheet is also included.

Further, in the above-described embodiment, a sheet discharge device for discharging a sheet such as a recording sheet to be recorded has been exemplified, but the invention is not limited thereto. For example, even when applied to a sheet discharge device for discharging a sheet such as an original to be read, the same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-209135, filed Oct. 26, 2016, which is hereby incorporated by reference herein in its entirety.

What is claimed is:

1. A sheet discharge device comprising:

a conveying portion which includes a first roller contacting a first surface of a sheet and a second roller contacting a second surface of the sheet and which conveys the sheet in a conveying direction with the sheet nipped between the first roller and the second roller;

a first conveying guide which is provided upstream of the conveying portion in the conveying direction to guide the first surface of the sheet;

a second conveying guide which is provided to face the first conveying guide to guide the second surface of the sheet;

a rotating portion which is disposed on a shaft of the first roller and has an outer diameter larger than that of the first roller; and a guide portion which is provided in the first conveying guide and in which an interval between the guide portion and the second conveying guide becomes narrower toward a downstream side in the conveying direction, the guide portion being located at a position corresponding to the rotating portion in a sheet width direction orthogonal to the conveying direction.

2. The sheet discharge device according to claim 1, wherein the first roller rotates by receiving driving from a motor, and wherein the second roller is driven by the first roller.

3. The sheet discharge device according to claim 1, wherein the guide portion is formed such that an entry angle of the sheet guided by the guide portion to the rotating portion is the same as an entry angle of the sheet to the first roller.

4. The sheet discharge device according to claim 1, wherein a second guide portion, in which an interval between the second guide portion and the opposite first conveying guide becomes narrower toward a downstream side in the conveying direction, is provided at a position of the second conveying guide corresponding to the second roller.

5. The sheet discharge device according to claim 1, wherein the rotating portion deflects the sheet nipped by the first roller and the second roller.

6. The sheet discharge device according to claim 1, wherein the conveying portion discharges the sheet to the outside of the sheet discharge device.

7. An image forming apparatus comprising:

an image forming portion which forms an image on a sheet; and a sheet discharge device which discharges the sheet, wherein the sheet discharge device includes:

(1) a conveying portion which includes a first roller contacting a first surface of a sheet and a second roller contacting a second surface of the sheet and which conveys the sheet in a conveying direction with the sheet nipped between the first roller and the second roller;

(2) a first conveying guide which is provided upstream of the conveying portion in the conveying direction to guide the first surface of the sheet;

(3) a second conveying guide which is provided to face the first conveying guide to guide the second surface of the sheet;

(4) a rotating portion which is disposed on a shaft of the first roller and has an outer diameter larger than that of the first roller; and (5) a guide portion which is provided in the first conveying guide and in which an interval between the guide portion and the second conveying guide becomes narrower toward a downstream side in the conveying direction, the guide portion being located at a position corresponding to the rotating portion in a sheet width direction orthogonal to the conveying direction.

8. The image forming apparatus according to claim 7, wherein the first roller rotates by receiving driving from a motor, and wherein the second roller is driven by the first roller.

9. The image forming apparatus according to claim 7, wherein the guide portion is formed such that an entry angle of the sheet guided by the guide portion to the rotating portion is the same as an entry angle of the sheet to the first roller.

10. The image forming apparatus according to claim 7, wherein a second guide portion, in which an interval between the second guide portion and the opposite first conveying guide gradually narrows toward the downstream side in the conveying direction, is provided at a position of the second conveying guide corresponding to the second roller.

11. The image forming apparatus according to claim 7, wherein the rotating portion deflects the sheet nipped by the first roller and the second roller.

12. The image forming apparatus according to claim 7, wherein the conveying portion discharges the sheet to the outside of the image forming apparatus.

* * * * *